US005361737A

United States Patent [19]

Smith et al.

[11] Patent Number: 5,361,737

[45] Date of Patent: Nov. 8, 1994

[54] RADIO FREQUENCY COAXIAL CAVITY RESONATOR AS AN IGNITION SOURCE AND ASSOCIATED METHOD

[75] Inventors: James E. Smith; Robert M. Craven; Kurt L. VanVoorhies, all of Morgantown; Thomas J. Bonazza, Fairmont, all of W. Va.

[73] Assignee: West Virginia University, Morgantown, W. Va.

[21] Appl. No.: 164,660

[22] Filed: Dec. 9, 1993

Related U.S. Application Data

[63] Continuation of Ser. No. 954,445, Sep. 30, 1992, abandoned.

[51] Int. Cl.[5] ..... F02P 23/00

[52] U.S. Cl. ..... 123/143 B

[58] Field of Search ..... 123/143 B, 143 R, 606

[56] References Cited

U.S. PATENT DOCUMENTS

| | | | |
|---|---|---|---|
| 3,473,879 | 10/1969 | Berberich | 123/143 B |
| 4,416,226 | 11/1983 | Nishida et al. | 123/143 B |
| 4,446,826 | 5/1984 | Kimura et al. | 123/143 B |
| 4,523,552 | 6/1985 | Mukainakano et al. | 123/143 B |
| 4,561,406 | 12/1985 | Ward | 123/143 B |
| 4,760,820 | 8/1985 | Tozzi | 123/143 B |
| 4,852,529 | 8/1989 | Vowles | 123/143 B |

*Primary Examiner*—Raymond A. Nelli

*Attorney, Agent, or Firm*—Arnold B. Silverman; David V. Radack

[57] ABSTRACT

An apparatus for providing an ignition source for internal combustion engines comprises a radio frequency oscillator, an amplifier and a coaxial cavity resonator. The coaxial cavity resonator is adaptable for communication with a combustion chamber of the internal combustion engine. An associated method is also provided.

35 Claims, 5 Drawing Sheets

RADIO FREQUENCY COAXIAL CAVITY RESONATOR AS AN IGNITION SOURCE AND ASSOCIATED METHOD

This application is a continuation of Ser. No. 07/954,445, filed Sep. 30, 1992, now abandoned.

BACKGROUND OF THE INVENTION

1. Field of the Invention

This invention relates to a new ignition source for internal combustion engines, utilizing a radio frequency (RF) coaxial cavity resonator to produce a non-propelled plasma.

2. Description of the Related Art

Most prior art ignition sources attempt to ignite and completely burn a combustible fuel for maximum energy output and to minimize unwanted emissions i.e., pollutants. With regards to internal combustion engines, placement and/or volume of ignition energy are factors studied by industry to optimize engine performance. Methods of increasing the ignition energy volume fall into two categories: (a) changing the spark characteristics of spark ignition systems and (b) the use of plasma. Heretofore, plasma ignition sources have propelled the plasma entity at high velocities into the combustion chambers. This type of plasma ignition requires the consumption off large amounts of power, thus rendering these devices impracticable for automotive applications.

It is also known to generate a plasma using radio frequency power in a coaxial cavity resonator having an electrical length one-quarter of the radio frequency wavelength. The coaxial resonator is formed between two coaxial conductors which are shorted at the input end and electrically open at the output end. In this way, the input voltage is resonantly amplified to produce a plasma at the open end of the resonator.

Automotive internal combustion engines today burn air/fuel ratios between about 14:1 and 19:1, the latter being leaner. It is generally known by those skilled in the art of internal combustion engines that automotive engine fuel economy improves with leaner air/fuel ratios. Generally, the lean limiting value of air/fuel ratio is governed by vehicle drivability, which is in turn related to the consistency and smoothness of the combustion process. One way of improving automotive engine fuel economy is to provide a means for obtaining consistent and smooth combustion at air/fuel ratios which are leaner than possible with present ignition systems.

Significant improvement of standard spark ignitions cannot be attained because they ignite only a localized region of the combustion chamber, making ignition of very lean air-to-fuel mixtures difficult, or some stratified charge mixtures. This leaves plasma ignition, which heretofore has required large amounts of source power.

The prior art devices are either ineffective or use excessive amounts of power in order to burn sufficiently lean air/fuel mixtures. It is therefore an object of the invention to provide an apparatus for burning lean air-to-fuel mixtures greater than 19:1.

Another object off the invention is to provide an apparatus which requires considerably less power than existing plasma ignition systems.

A still further object is to provide an apparatus which is adaptable for use with existing internal combustion engines.

SUMMARY OF THE INVENTION

The present invention meets the above and other needs. An apparatus for providing an ignition source for internal combustion engines comprises a radio frequency oscillator for providing radio frequency power, an amplifier coupled with the radio frequency oscillator, and a coaxial cavity resonator coupled with the amplifier for generating a plasma. The resonator is adaptable for securement in communication with combustion chambers of an internal combustion engine. The present invention provides a larger volume of plasma relative to the localized plasma from a conventional spark plug, thus enabling a wider range of air/fuel mixtures to be burned.

The method of the invention involves generating a radio frequency power of considerably less power than existing ignition systems at a particular wavelength, amplifying the radio frequency voltage, and resonating the radio frequency voltage through a coaxial cavity resonator to produce a plasma wherein the resonator is adaptable for engagement with a combustion chamber of the engine.

BRIEF DESCRIPTION OF DRAWINGS

A full understanding of the invention can be gained from the following description of the preferred embodiment when read in conjunction with the accompanying drawings in which.

DESCRIPTION OF THE PREFERRED EMBODIMENT

Figure 1:
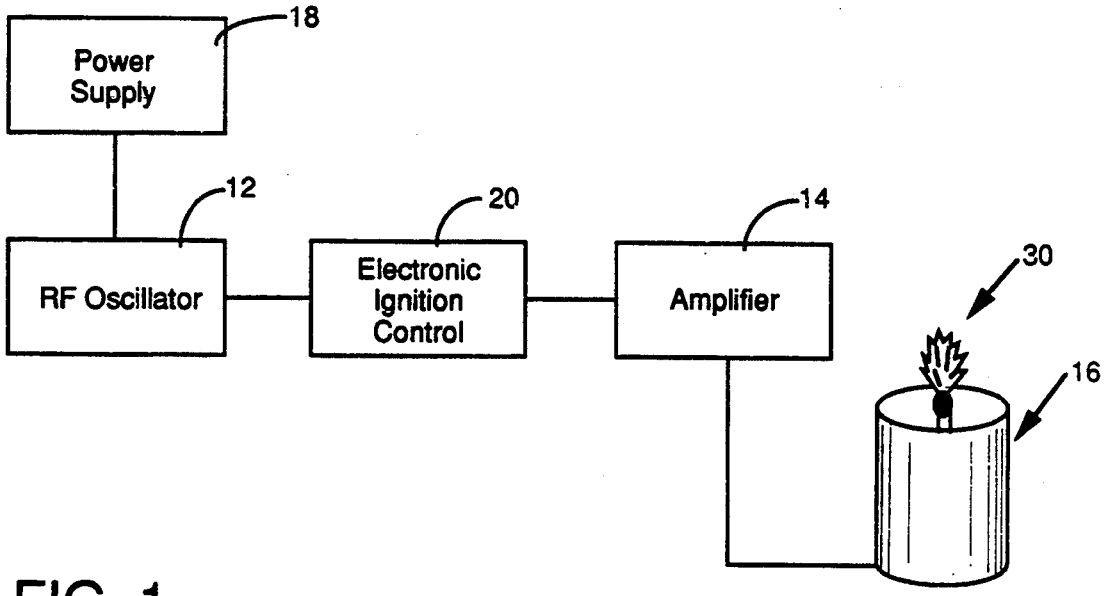
FIG. 1 is a schematic diagram of the apparatus of the invention.

An apparatus for providing an ignition source for internal combustion engines is shown in FIG. 1. The apparatus comprises a radio frequency (RF) oscillator 12, an amplifier 14, and a coaxial cavity resonator 16. While a specific embodiment of the invention employed in an automotive engine is provided herein for illustrative purposes, it should be understood by those skilled in the art that other embodiments and alternatives could be employed in light of the overall teachings of the disclosure.

Figure 2:
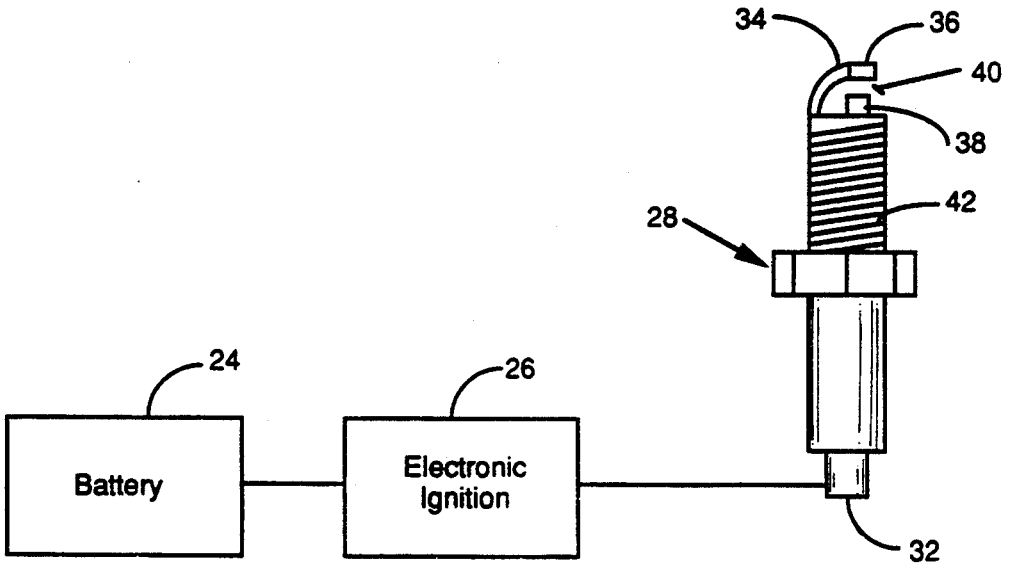
FIG. 2 PRIOR ART
FIG. 2 is a schematic diagram of a prior art apparatus.

The RF oscillator 12, as shown in FIG. 1, operates from a conventional automobile power supply 18, such as a 12-volt battery, and is operably coupled with an electronic ignition control device 20. A conventional automobile ignition system is shown in FIG. 2 and includes a battery 24, electronic ignition 26, and a spark plug 28. Comparing FIG. 1 with FIG. 2, it can be seen that coaxial cavity resonator 16 replaces the spark plug 28 in the conventional ignition system and RF oscillator 12 and amplifier 14 are added to the circuit, in order to provide plasma 30 at the terminal end of the resonator 16.

Again referring to FIG. 2, the prior art provides elongated spark plug 28 having opposed ends 32,34 wherein end 32 is coupled with electronic ignition 26 and end 34 includes electrodes 36 and 38 defining a gap 40 therebetween. Threads 42 engage a conventional motorblock such that electrodes 36 and 38 are exposed within a combustion chamber of a conventional automobile engine. When the spark plug 28 is energized and generates a plasma in the gap 40, the plasma or ignition energy is contained only within that gap. That is to say, the ignition energy of the spark plug 28 is localized to the area between the electrodes 36 and 38. The ignition energy of spark plug 28 is sufficient to burn air/fuel mixtures of less than 19:1, but mixtures any leaner generally will not be reliably combusted. This is because when the air/fuel mixture is leaner than 19:1, the mixture is not uniform throughout the combustion chamber, and therefore may not be combustible within the electric field region of electrodes 36 and 38, but is likely to be combustible at other locations in the combustion chamber.

The RF oscillator 12 of FIG. 1, preferably is capable of generating frequencies between about 400 MHz and 4 GHz. The advantage of generating frequencies of this magnitude is that it allows the geometry of the coaxial cavity resonator 16 to be small enough to permit adaptation of the resonator to a conventional spark plug receptacle in an existing automobile engine. Preferably, RF oscillator 12 is adaptable to be powered by a conventional automobile power system such as a 12-volt supply.

The resonant frequency generated by the RF oscillator 12 is then amplified by amplifier 14 to generate a plasma. Preferably, the RF oscillator 12 and amplifier 14 are combined in a single class-C amplifier with resonator 16 acting as a tuning element. The RF voltage is amplified between 200 and 30,000 times to create a plasma allowing a plasma to be generated which is significantly larger than the spark generated by conventional spark plug, and in turn this allows a much leaner air/fuel mixture to be burned efficiently. A plasma 30 of approximately 0.25 to 10 cm. in length can be generated by the apparatus, which allows a much larger area of a combustion chamber to be energized relative to the ignition energy of a conventional spark plug. This larger energization area permits much less uniform combustion chamber air/fuel distribution, i.e., leaner mixtures, to be combusted, as explained hereinbefore. A further advantage of this larger energization area is that at stoichiometric ratios fuels are combusted more fully and with fewer pollutants being emitted to the atmosphere than with the ignition energy of a spark plug.

Figure 3:
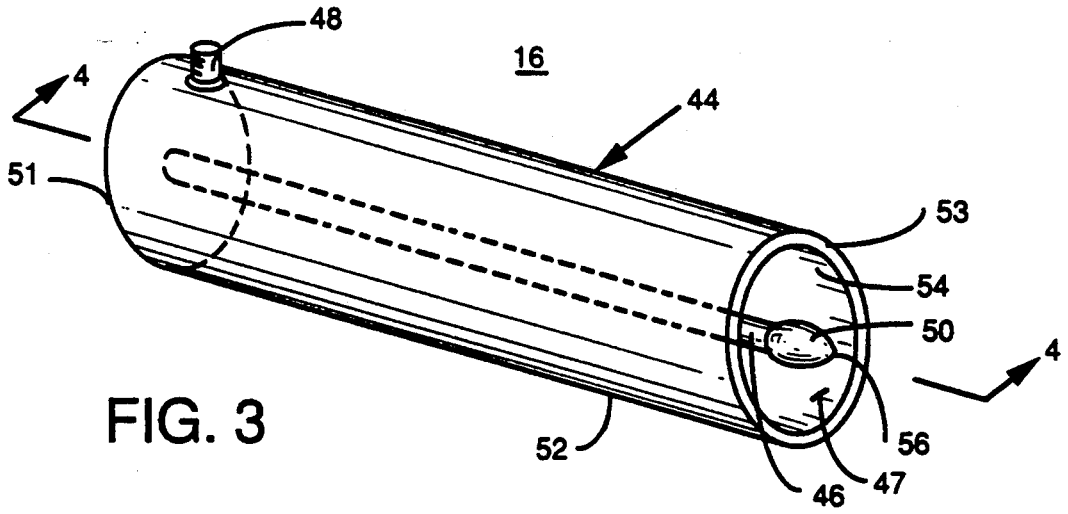
FIG. 3 is a perspective view of a coaxial cavity resonator of the invention.
Figure 4:
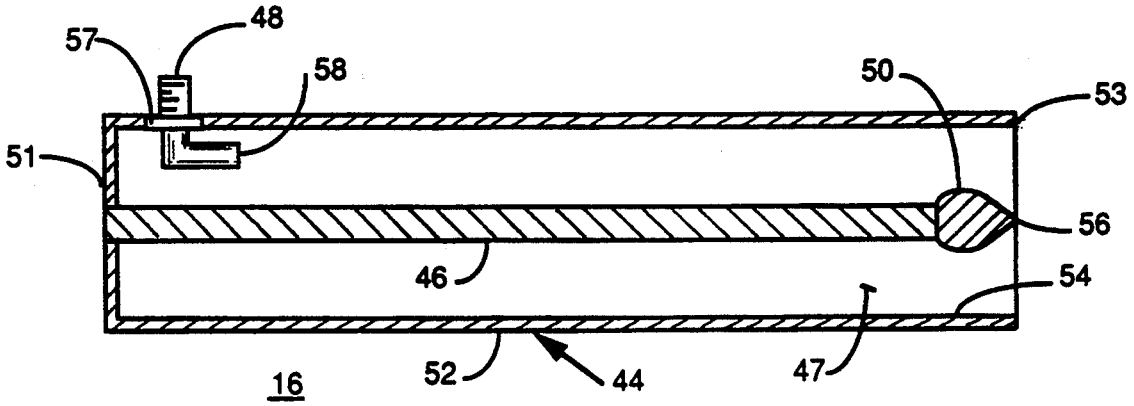
FIG. 4 is a cross-sectional view of the coaxial cavity resonator of FIG. 3 taken through 4—4.

The resonator 16, as shown in FIGS. 3 and 4, includes a conductive cavity housing 44, a center conductor 46, an RF connector 48 and an electrode 50. The cavity housing 44 is preferably hollow and generally cylindrical in shape and has solid annular structure presenting an outer surface 52 and inner surface 54, thereby creating a cavity 47. The housing 44 is preferably one-quarter of the electrical wavelength in length. In the preferred operating range of 1.5 GHz to 2.5 GHz, a housing 44 length of 1 to 5.5 cm. is preferred. The electrical wavelength is the length of a sinusoidal excitation oscillation signal as it is guided through cavity 47. This electrical wavelength is generally shorter than the free space wavelength because of reactive effects which act to slow the propagation velocity of the wave in cavity 47 relative to that of free space, as known by those skilled in the art. Additionally, a distance of between 3 and 15 electrical skin depths is preferred between surfaces 52 and 54, which in the preferred operating frequency range is between about 0.04 and 0.25 cm. The center conductor 46 is a rod of generally cylindrical shape, preferably between about 0.05 and 2 cm. in diameter, presenting opposed ends wherein said ends generally lie along a single axis which is the central longitudinal axis of housing 44. The cavity housing 44 and center conductor 46 are shorted together at one end 51 and open at the other end 53 such that cavity housing 44 generally surrounds and lies along the same axis as center conductor 46, as seen in FIGS. 3 and 4.

The length of center conductor 46 should be approximately equal to that of the cavity housing 44 and adjusted to maximize the field strength at open end 53 for a given geometry of electrode 50.

The diameter of center conductor 46 is determined relative to a diameter defined by inner surface 54, preferably between 1.2 and 3 cm. This diameter is determined with respect to the impedance created in resonator 16 and a voltage standing wave ratio of the resonator 16. A trade off must be made between matching the impedance of resonator 16 and producing a maximum standing wave ratio. It is preferred to obtain a ratio between the diameter of center conductor 46 and the diameter of inner surface 54 which produces the most voltage at electrode 50 with minimal power losses due to unmatched impedance between resonator 16 and the RF oscillator 12.

The RF connector 48 is attached to resonator 16 adjacent shorted end 51 of the cavity housing 44. The electrode 50 is formed of a metal or semi-metallic conductor, preferably stainless steel, which can withstand the temperature conditions near the plasma discharge without deformation, oxidation or loss. The electrode 50 is attached to the open end of the center conductor 46 and is of a generally teardrop shape with an apex 56 as its endmost point. The electrical length of the resonator 16 is preferably one-quarter of the resonant frequency wavelength generated by RF oscillator 12 so that the input voltage may be resonantly amplified to produce a plasma at the open end of the resonator 16.

The cavity housing 44 and center conductor 46 are preferably composed of material taken from the group of copper, aluminum or other good electrical conductor in order to provide high conductivity and low power absorption in the cavity housing 44. Also, low electrical loss and non-porous ceramic dielectric materials such as one selected from the group consisting of aluminum oxide, silicon oxide, magnesium oxide, calcium oxide, barium oxide, magnesium silicate, alumina silicate, and boron nitride may be inserted between the inner surface 54 and center conductor 56 in order to fill the cavity 47 to minimize physical perturbation of an engine combustion chamber and electrical perturbation to the resonator 16.

Now, referring to FIG. 4, it can be seen that RF connector 48 preferably forms a single loop feed 58 at the base. This allows the resonator 16 to operate at a high potential and corresponding E field at the single electrode 50 by virtue of the cavity being electrically one-quarter of resonant frequency wavelength in length. The single loop feed 58 may be replaced by a feed element in capacitive relation to center conductor 46 or in direct connection with center conductor 46 at a point displaced from but near shorted end 51, as known to those skilled in the art.

It is noted that the plasma generated by the ignition system shown in FIG. 1 is non-propelled which is a significant departure from the prior art. Up to this point plasma ignition systems have required the plasma to be propelled through a combustion chamber of an engine, and hence, large amounts of power were necessary in order to propel this plasma. In the present invention, however, the plasma in non-propelled, thus allowing a much smaller power consumption in the system. The apparatus of FIG. 1, preferably, requires less power than the approximately 1000 watts required by the prior art.

Figure 5:
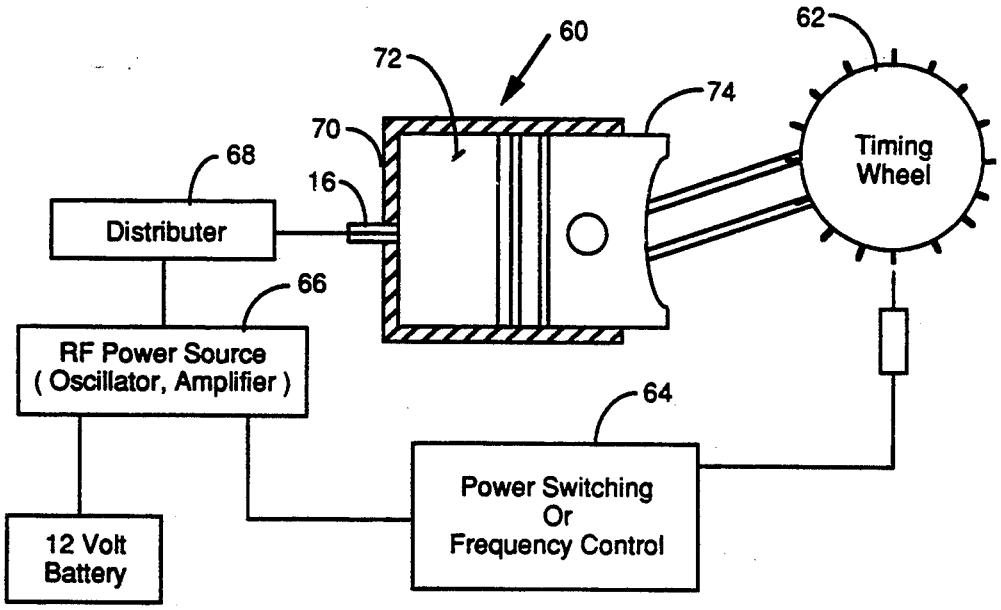
FIG. 5 is a schematic diagram of a use of the invention with an internal combustion engine.

Referring to FIG. 5, the invention is shown in connection with the operation of a cylinder 60 of an internal combustion engine. It is understood that a separate resonator 16 is required for each cylinder of the engine. In operation, the apparatus receives a timing signal from a timing wheel 62 through a power switching or frequency control circuit 64 which operates to turn an RF power source 66 on and off at the proper time. RF power source 66 may be RF oscillator 12 combined with amplifier 14 (FIG. 1) and powered by a 12-volt battery such as is commonly found in today's automobiles. When a signal is received from the power switching or frequency control circuit 64, the RF power source 66 is turned on and a distributor 68 sends the amplified RF power to the resonator 16 which is attached to a cylinder head 70 of a combustion chamber 72 and in communication therewith thereby creating a plasma which ignites an air/fuel mixture in the combustion chamber 72. The resonator 16 is attached to cylinder head 70 by means of a conventional threaded connection or is integral to cylinder head 70 [not shown].

The ignition of the air/fuel mixture causes the displacement of a piston 74 which turns the timing wheel 62 to set the next firing sequence. Because the plasma generated reaches well into the combustion chamber as compared to the ignition energy of a conventional spark plug, air/fuel mixtures which are very lean, that is, greater than 19:1, can be burned efficiently thereby increasing fuel economy and decreasing the emission of pollutants into the atmosphere.

As is seen in FIG. 5, conventional timing mechanisms may be used in connection with the use of the present invention. Alternatively, ignition could be controlled through the frequencies generated in resonator 16. In this alternative embodiment, combustion chamber 72 is treated as a perturbing element to the resonator 16, such that the frequency of the combined combustion chamber 72 and resonator 16 will be related to the position of piston 74. The resonator is then excited at the resonant frequency of the combined combustion chamber 72 and resonator 16, and when the piston 74 reaches the desired position, the cavity is maximized, as known to those skilled in the art, thus enabling a plasma to be generated at the electrode 50 at the proper time.

Figure 6:
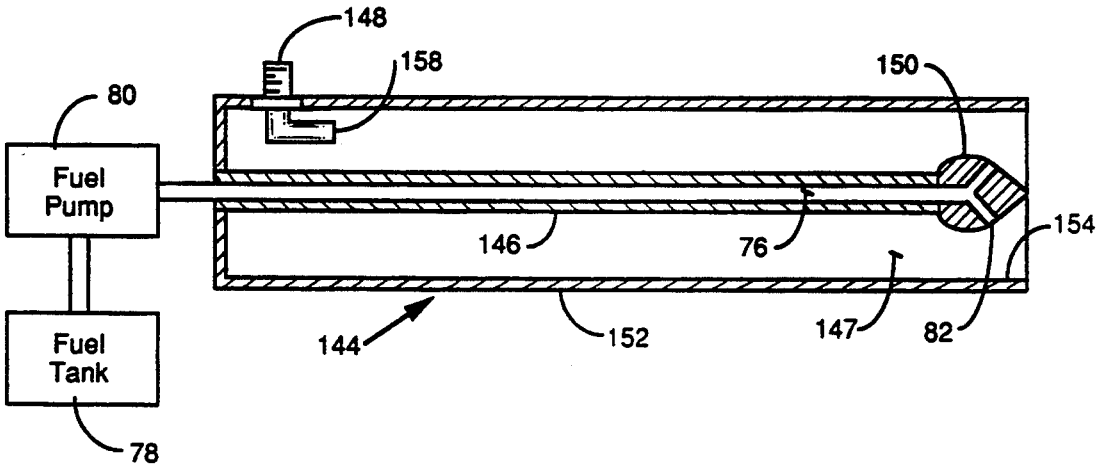
FIG. 6 is a cross-sectional view of an alternative embodiment of the coaxial resonator of the invention.

Another embodiment of the invention is shown in FIG. 6. This embodiment includes cavity housing 144, center conductor 146, cavity 147, RF connection 148, and electrode 150. The embodiment of FIG. 6 is identical to that explained hereinbefore except that center conductor 146 and electrode 150 have structures defining a fuel line 76 within center conductor 146 and electrode 150.

Figure 7:
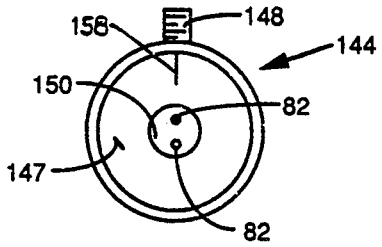
FIG. 7 is an end view of the alternative embodiment of FIG. 6.

In operation, fuel is pumped from a fuel tank 78 by a fuel pump 80 through fuel line 76 wherein the fuel is delivered through one or more openings 82 contained within electrode 150. Two openings are shown in FIG. 7, though other configurations and numbers of openings 82 could be used. In this manner, the fuel is introduced directly at the source of the ignition energy, thereby allowing very efficient combustion to be achieved.

FIGS. 8–11 illustrate four alternative modifications to the invention disclosed above for altering the size and/or movement of the plasma generated by resonator 44. The physical extent of the plasma generated by resonator 44 is governed by the geometry of the electrode 50 and the magnitude of the voltage at the apex 56. The purpose of the modifications, as shown in FIGS. 8–11, is to increase the volume of space in the combustion chamger 72 with which the plasma to be generated will interact.

The plasma created by the electrode 50 is quasi-neutral, i.e., the plasma contains roughly equal numbers of electrons and positive ions. In the presence of the high-frequency AC field generated by RF oscillator 12, the positive ions remain virtually stationary with respect to the highly mobile, energetic electrons. Energetic electrons create positive ions in collision with neutral atoms and molecules, and the chemical combination of specific ions results in combustion.

RF feed 58 is electrically insulated from housing 44 and housing 44 is insulated from cylinder head 70. A DC or quasi-steady AC potential is then applied to housing 44 and center conductor 46 without effecting the resonance of cavity 47. This electrostatic potential influences the plasma, either attracting or repelling electrons.

The overall potential of cavity 47 can be modulated with respect to combustion chamber 72 in a variety of ways, as depicted in FIGS. 8–11. The goal of the modulation is to modify the composite electrostatic field in such a manner as to enlarge the volume of the plasma generated or translate the plasma further into combustion chamber 72 and away from electrode 50. These modulations are achieved through either sinusoidal excitations, sawtooth excitations or ramped excitations of fixed or modulated amplitudes or frequencies.

Figure 8:
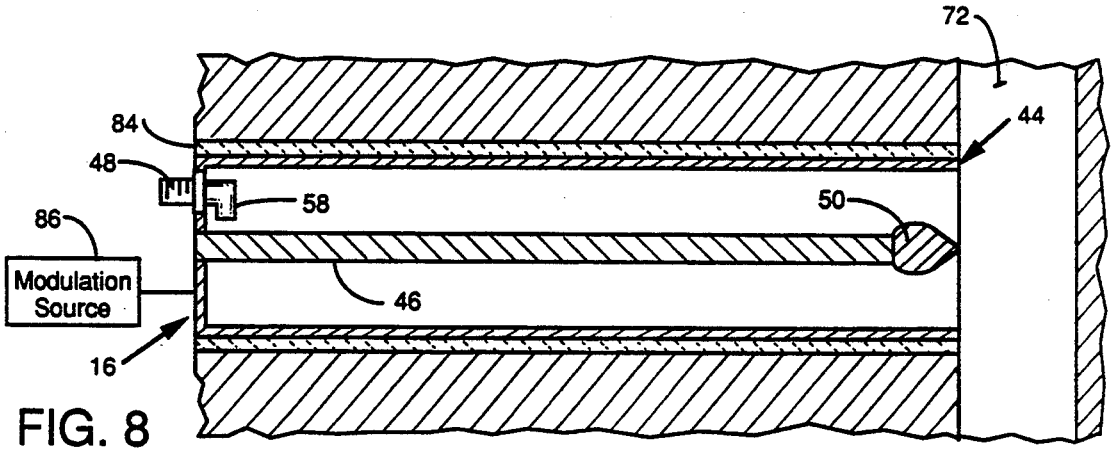
FIGS. 8–11 are schematic diagrams of alternate modifications of the coaxial resonator of the invention.

In FIG. 8 the entire cavity resonator 16 is electrically insulated from cylinder head 70 by an insulating material 84 such as dielectric material described above. The entire resonator 16 can then be excited by external modulation source 86 thereby causing resonator 16 to act as a lumped conductive circuit element at the modulation frequencies.

Figure 9:
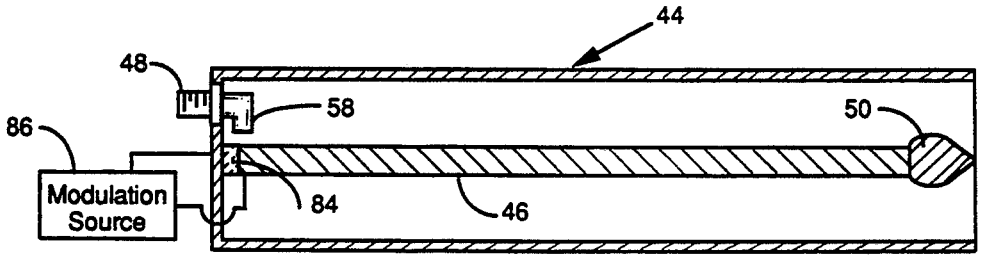

FIG. 9 illustrates center conductor 46 being DC isolated from resonator housing 44 by insulating material 84. Resonator housing 44 is then grounded to cylinder head 70 and modulation source 86 is applied to the base of center conductor 46, as shown in FIG. 9. Capacitance between the base of center electrode 46 and housing 44 enables the resonator 16 to resonate as if conductor 46 were normally connected thereto.

Figure 10:
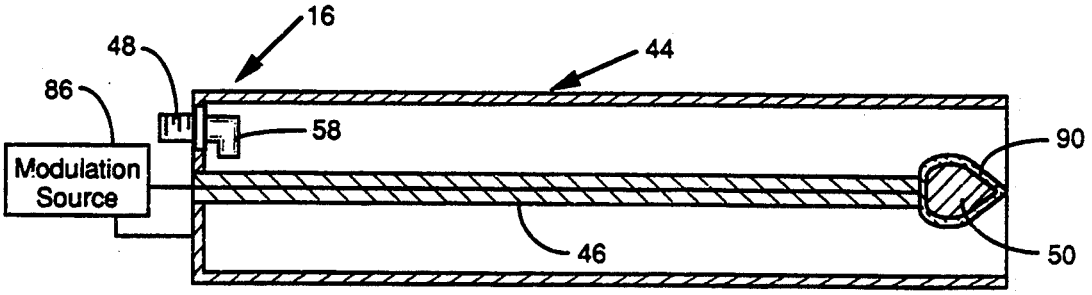

In FIG. 10, electrode 50 is surrounded by conductive layer 90, such as copper, aluminum or other good conductor, which is in capacitive relation to the electrode 50 by means of a high temperature dielectric, such as mica (not shown), placed between electrode 50 and conductive layer 90. A modulation voltage from modulation source 86 is then applied between conductive layer 90 and housing 44 and grounded to cylinder head 70. The potential applied to conductive layer 90 would then influence the motion of the plasma generated, wherein conductive layer 90 is designed not to interfere with the high field region of electrode 50.

Figure 11:
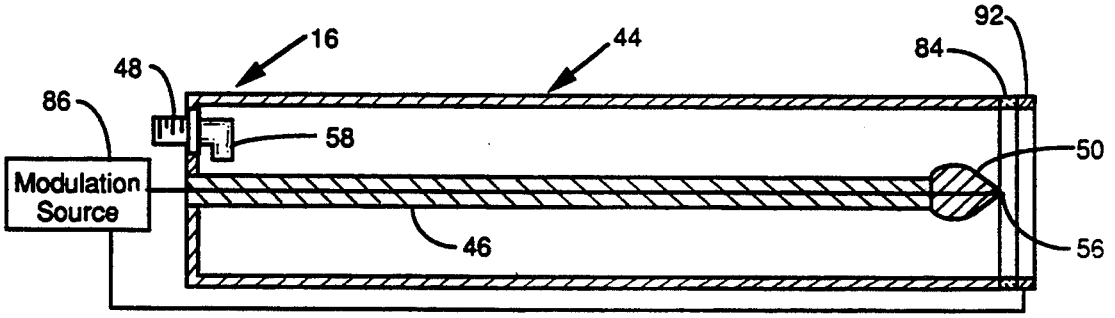

Finally, the modulation embodiment of FIG. 11 illustrates a modulation voltage from modulation source 86 being applied between apex 56 of electrode 50 and an annular ring 92 which is insulated from housing 44 by insulating material 84. The fields produced between apex 56 and annular ring 92 would then influence the motion of the plasma generated.

While for simplicity of disclosure specific reference has been made to automotive engines, it will be appreciated that the invention is adaptable for use in a wide variety of internal combustion engines, such as boats, lawn mowers, snowmobiles and airplanes, for example.

While specific embodiments have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

We claim:

1. An apparatus for providing an ignition source for internal combustion engines, said apparatus comprising:

radio frequency oscillator means for providing radio frequency power from the electrical power source of said internal combustion engine;

amplifier means operably coupled with said radio frequency means for amplifying said radio frequency power;

coaxial cavity resonator means having an output end portion terminating in a discharge electrode, said resonator means being operably coupled with said amplifier means for generating an RF corona discharge which ionizes a surrounding gaseous medium to create a plasma at said discharge electrode; and said resonator means being adaptable for communication with a combustion chamber of said internal combustion engine.

2. The apparatus of claim 1, wherein said radio frequency oscillator means operates from a conventional automobile 12-volt supply.

3. The apparatus of claim 1, wherein said radio frequency oscillator means is capable of generating oscillations between about 400 MHz and 4 GHz.

4. The apparatus of claim 1, wherein said radio frequency oscillation means and said amplifier means together form a single class-C amplifier.

5. The apparatus of claim 4, wherein said resonator means is operably coupled with said class-C amplifier to operate as a tuning element therefor.

6. The apparatus of claim 1, wherein said resonator means is adapted to generate plasma which is non-propelled.

7. The apparatus of claim 1, wherein said radio frequency oscillation means produces power at a particular wavelength, and said resonator means having an electrical length one-quarter of said wavelength.

8. The apparatus of claim 1, wherein a separate coaxial cavity resonator is coupled with each combustion chamber of each internal combustion engine.

9. The apparatus of claim 1, wherein said internal combustion engine includes a piston disposed within said combustion chamber, said apparatus further including:

frequency timing means for timing the generation of the plasma with respect to a position of said piston by sensing change in frequency in said combustion chamber and coaxial resonator means.

10. The apparatus of claim 1, said resonator means including:

a center conductor presenting an input end and an output end, said conductor generally lying along one axis;

a cavity housing having a generally cylindrical tubular shape presenting an input end and an output end, said cavity housing generally surrounding said center conductor and lying along the same axis as said center conductor; and each of the input ends being electrically shorted together and said output ends being electrically open relative to each other such that the output ends of said center conductor and cavity housing essentially align.

11. The apparatus of claim 10, wherein said center conductor output end has capacitive characteristics.

12. The apparatus of claim 10, wherein a dielectric material consists of one selected from the group consisting of the list of materials on page 8 is placed between said center conductor and cavity housing within said input and output ends.

13. The apparatus of claim 10, wherein said center conductor and cavity housing are composed of one selected from the group consisting of copper, aluminum, iron and steel.

14. The apparatus of claim 10, further including:

structure defining a passageway through said center conductor wherein said passageway generally lies along the same axis as said center conductor, thereby allowing a fuel mixture to be exited at the output end of said center conductor.

15. The apparatus of claim 14, further including an electrode coupled with the output end of said center conductor, said electrode have structure defining at least one opening communicating with said passageway.

16. The apparatus of claim 10, further including:

plasma modulation means for modulating a plasma generated by said resonator means.

17. The apparatus of claim 16, wherein said plasma modulation means includes electrical insulating means for insulating said housing from said internal combustion engine and modulation means coupled with said housing for causing said resonator means to act as a lumped conductive element.

18. The apparatus of claim 16, wherein said plasma modulation means includes DC isolation means for isolating said center conductor from said housing and modulation means coupled with said housing and center conductor.

19. The apparatus of claim 16, wherein said plasma modulation means includes a conductive layer surrounding at least a portion of said center conductor, said conductive layer having a capacitive relationship with said center conductor and modulation means coupled with said conductive layer and said housing.

20. The apparatus of claim 16, wherein said plasma modulation means includes a conductive annual ring coupled with said housing, said annular ring being electrically insulated from said housing and modulation means coupled with said output end of said center conductor and said annular ring.

21. The apparatus of claim 1, wherein said internal combustion engine burns an air-to-fuel ratio of greater than 19:1.

22. The apparatus of claim 1, wherein said internal combustion engine emits fewer pollutants relative to conventional spark plug internal combustion engines.

23. An apparatus for providing an RF corona discharge which ionizes a surrounding gaseous medium to create a plasma, said apparatus comprising:

an internal combustion engine, wherein said engine includes at least one combustion chamber, said combustion chamber presenting structure defining a receptacle for an ignition source;

coaxial cavity resonator means including an output end portion terminating in a discharge electrode, said resonator means being operably coupled with said receptacle for providing an RF corona discharge which ionizes a surrounding gaseous medium to create a plasma ignition source at said discharge electrode; and a radio frequency power source means operably coupled with said coaxial cavity resonator means for providing radio frequency power to resonate through said coaxial cavity resonator means to produce an RF corona discharge which ionizes a surrounding gaseous medium to create a plasma at said discharge electrode.

24. The apparatus of claim 23, wherein said radio frequency power source means operates from a conventional automobile 12-volt supply.

25. The apparatus of claim 23, wherein said radio frequency power source is a single class-C amplifier.

26. The apparatus of claim 25, wherein said resonator means is operably coupled with said class-C amplifier to operate as a tuning element therefor.

27. The apparatus of claim 23, wherein said radio frequency power source produces power at a particular wavelength, and said resonator means having an electrical length of one-quarter of said wavelength.

28. The apparatus of claim 23, said resonator means including:

a center conductor presenting an input end and an output end, said conductor generally lying along one axis;

an cavity housing having a generally cylindrical tubular shape presenting an input end and an output end, said cavity housing generally surrounding said center conductor and lying along the same axis as said center conductor; and each of the input ends being electrically shorted together and said output ends being electrically open relative to each other such that the output ends of said center conductor and cavity housing essentially align.

29. The apparatus of claim 28, further including:

structure defining a passageway through said center conductor wherein said passageway generally lies along the same axis as said center conductor, thereby allowing a fuel mixture to be exited at the output end of said center conductor.

30. The apparatus of claim 29, further including an electrode coupled with the output end of said center conductor, said electrode have structure defining at least one opening communicating with said passageway.

31. The apparatus of claim 28, further including:

plasma modulation means for modulating a plasma generated by said resonator means.

32. The apparatus of claim 31, wherein said plasma modulation means includes electrical insulating means for insulating said housing from said internal combustion engine and modulation means coupled with said housing for causing said resonator means to act as a lumped conductive element.

33. The apparatus of claim 31, wherein said plasma modulation means includes DC isolation means for isolating said center conductor from said housing and modulation means coupled with said housing and center conductor.

34. The apparatus of claim 31, wherein said plasma modulation means includes a conductive layer surrounding at least a portion of said center conductor, said conductive layer having a capacitive relationship with said center conductor and modulation means coupled with said conductive layer and said housing.

35. The apparatus of claim 31, wherein said plasma modulation means includes a conductive annual ring coupled with said housing, said annular ring being electrically insulated from said housing and modulation means coupled with said output end of said center conductor and said annular ring.

* * * * *